US005856010A

United States Patent [19]

Furuya et al.

[11] Patent Number: 5,856,010

[45] Date of Patent: Jan. 5, 1999

[54] SURFACE-TREATED PLASTIC FILM AND INK JET RECORDING MATERIAL

[75] Inventors: Yoshikazu Furuya; Toshitake Suzuki; Toshiaki Doi; Katsuya Ito; Takashi Saito; Shinji Sawasaki; Yasushi Sasaki, all of Ohtsu, Japan

[73] Assignee: Toyo Boseki Kabushiki Kaisha, Osaka, Japan

[21] Appl. No.: 652,902

[22] Filed: May 23, 1996

[30] Foreign Application Priority Data

May 26, 1995 [JP] Japan ..... 7-128440

[51] Int. Cl.[6] ..... B41M 5/00

[52] U.S. Cl. ..... 428/407; 428/195; 428/304.4; 428/402; 428/480; 428/484; 428/910

[58] Field of Search ..... 428/480, 304.4, 428/206, 483, 331, 195, 484, 914, 402, 407, 910

[56] References Cited

U.S. PATENT DOCUMENTS

| | | | |
|---|---|---|---|
| 4,892,787 | 1/1990 | Kruse et al. | 428/331 |
| 5,422,175 | 6/1995 | Ito et al. | 428/483 |
| 5,427,847 | 6/1995 | Zawada | 428/914 |

FOREIGN PATENT DOCUMENTS

| | | |
|---|---|---|
| 0 199 874 | 5/1986 | European Pat. Off. . |
| 0 539 678 A1 | 5/1993 | European Pat. Off. . |
| 0 586 846 A1 | 3/1994 | European Pat. Off. . |
| 43 18 232 A1 | 6/1993 | Germany . |
| 62-109832 | 5/1987 | Japan . |
| 110539 | 4/1989 | Japan . |

OTHER PUBLICATIONS

European Search Report for corresponding patent applicaton No. EP 96 10 8147 dated Aug. 8, 1996.

*Primary Examiner*—Pamela R. Schwartz
*Attorney, Agent, or Firm*—Morrison & Foerster LLP

[57] ABSTRACT

A surface-treated plastic film having a surface coating layer formed on at least one surface of a plastic film, which has a spreading index of aqueous and alcohol inks of 1.0–1.2, respectively, at the surface coating layer side thereof, and an ink jet recording material. The surface-treated plastic film of the present invention having respective spreading indices of aqueous and alcohol inks of 1.0–1.2 allows less spreading of the aqueous ink of ballpoint pens, is superior in writability and offset printability, and is extremely useful as a synthetic paper. In addition, the use of such surface-treated plastic film enables production of an ink jet recording material permitting high grade recording.

7 Claims, No Drawings

SURFACE-TREATED PLASTIC FILM AND INK JET RECORDING MATERIAL

FIELD OF THE INVENTION

The present invention relates to a surface-treated plastic film useful as various labels, delivery slips, recording paper for printers, and the like, and more particularly, the invention relates to a surface-treated plastic film superior in selective absorption and prevention of diffusion of an aqueous or alcohol ink widely used for aqueous ink pens, stamps, sealing vermilion inkpads and the like, which film having markedly improved writability and printability. The present invention also relates to an ink jet recording material comprising said surface-treated plastic film, which enables high grade image printing.

BACKGROUND OF THE INVENTION

A plastic film is superior in water resistance, dimensional stability upon moisture absorption, surface smoothness, gloss and vividness of printed matters, as well as mechanical strength as compared to natural papers, and has been widely used as a synthetic paper replacing natural papers to be used for, for example, wrapping papers, labels, maps, posters, name cards, delivery slips and recording papers for various printers.

On the other hand, conventional plastic films have smooth surfaces and barely absorb aqueous inks and alcohol inks, which in turn results in poor writability with pencils, ball-point pens, aqueous ink pens and the like. In addition, such films are associated with difficulty in that the ink dries slowly and spreading of the ink causes poor legibility.

It is therefore an object of the present invention to improve absorption of aqueous inks and alcohol inks on the surface of a plastic film, thereby to improve writability with aqueous ink pens and the like and to enhance acceptability of stamp ink, vermilion ink and the like, so that the plastic film of the present invention can be used, without difficulty, as a synthetic paper to replace natural papers for, for example, labels for general use, bar corde labels, delivery slips, recording papers for various printers and information recording papers.

A further object of the present invention is to provide an ink jet recording material comprising such surface-treated plastic film which permits high grade recording.

SUMMARY OF THE INVENTION

According to the present invention, the following are provided.

① A surface-treated plastic film comprising a surface coating layer formed on at least one surface of a plastic film, which has a spreading index of aqueous and alcohol inks of 1.0–1.2, respectively, at the surface coating layer side thereof.

② The surface-treated plastic film of ①, wherein the surface coating layer comprises, as essential components, inorganic particles subjected to organic surface treatment and/or inorganic surface treatment, a polymer wax, and an aqueous resin or a resin soluble in organic solvent.

③ The surface-treated plastic film of ①, wherein the surface coating layer comprises, as essential components, inorganic particles subjected to organic surface treatment and/or inorganic surface treatment, a polymer wax, and an aqueous resin.

④ The surface-treated plastic film of any one of ① to ③, wherein the plastic film is a polyester film.

⑤ The surface-treated plastic film of ④, wherein the plastic film has an apparent specific gravity of 0.8–1.3, and the polyester film comprises a polyester and one or more thermoplastic resins incompatible with said polyester, which polyester film having fine voids formed by drawing in at least a monoaxial direction.

⑥ The surface-treated plastic film of any one of ① to ⑤, having a light permeability of not more than 30%, and an inplane birefringence of not less than −0.02 and not more than +0.04.

⑦ An ink jet recording material comprising an ink receiving layer on the surface coating layer of the surface-treated plastic film of any one of ① to ③.

DETAILED DESCRIPTION OF THE INVENTION

The surface-treated plastic film of the present invention characteristically has a surface coating layer on at least one surface of a plastic film, and the surface-treated plastic film has a spreading index of 1.0–1.2 to aqueous and alcohol inks, respectively, at the surface coating layer side.

When the ink spreading index is less than 1.0 in the case of, for example, sealing stamp inks, the film repels the sealing ink to make lines narrower or forms an empty spot in the line, so that the printed images become hard to read, whereas when it exceeds 1.2, the sealing ink spreads to make the stamp unreadable, thus failing to fulfill the function of the sealing stamps. The same applies to printing inks and writing inks.

The aqueous ink used in the present invention was Replenish ink:vermilion exclusively for Bando stamps (manufactured by Bando Corp.) and consisted of water/polymer glycol/alcohol/dye=40/30/20/10 (wt %). The alcohol ink was Shachihata stamp replenish ink:S-1 black (manufactured by Shachihata Kogyo Kabushiki Kaisha) and consisted of alcohol/water/dye/surfactant/others =50–60/20–30/5–10/1–3/1–3 (wt %).

In the present invention, the ink spreading index is determined by the following method.

A sample film is placed horizontally on a sample table of a stereoscopy equipped with a camera, so that the surface coating layer of the sample film comes on top, and an aqueous or alcohol ink (0.6 $\mu$l) is dropwisely placed on the top surface of the sample film with a microsyringe. The ink adhered area ($S_1$) just after the dropwise placing and the area ($S_2$) after 30 minutes are determined from the photographs taken under the same conditions. Using $S_1$ and $S_2$ thus obtained with respect to the aqueous and alcohol inks, the ink spreading index of the aqueous and alcohol inks is respectively determined from the following equation:

$$\text{ink spreading index}=S_2/S_1$$

The surface-treated plastic film of the present invention which satisfies such spreading index preferably has, on at least one surface of a plastic film, a surface coating layer which comprises, as essential components, inorganic particles subjected to organic surface treatment and/or inorganic surface treatment, a polymer wax, and an aqueous resin or a resin soluble in organic solvent.

The inorganic particles to be used in the present invention is subject to no particular limitation, and are exemplified by silica, calcium carbonate, calcium sulfate, barium sulfate, magnesium hydroxide, aluminum hydroxide, talc, zeolite, alumina, titanium dioxide and zinc oxide, with particular preference given to silica particles.

The particle size of the inorganic particles is preferably from 0.5 μm to 10 μm and more preferably from 1.0 μm to 5.0 μm.

The inorganic particles may be used alone or in combination. It is also possible to use two or more kinds of particles having different particle sizes.

In the present invention, the organic or inorganic surface treatment of the above-mentioned inorganic particle surfaces aims at making the particle surface partially hydrophobic to reduce secondary agglomeration, thereby to enhance particle dispersibility and to control the diffusion of the aqueous and alcohol inks.

The organic surface treatment is performed by, for example, silylation with a coupling agent [e.g., vinyltris(β-methoxyethoxy)silane and 3-aminopropyltriethoxysilane], esterification with higher fatty acid (e.g., stearic acid and palmitic acid), or a treatment with saturated hydrocarbon or resin (e.g., paraffin wax, stearamide, silicone resin and fluorocarbon resin).

The inorganic surface treatment is performed by, for example, surface reaction with an inorganic coupling agent, metallic alkoxide, metallic ion and the like, or ion exchange reaction.

Among others, the use of magnesium treating agent is preferable.

Such surface treatment is specifically exemplified by coating of surface treating agents used for the above-mentioned methods by spray coating on the surface of the inorganic particles, and adhesion of a treating agent to the surface of inorganic particles by immersing the particles in a solution of the surface treating agent.

The polymer wax which is among the essential components of the surface coating layer generally has low wettability with water and is a known polymer wax capable of dispersion or emulsification in water. Examples thereof are polyethylene, polypropylene, acrylic and aliphatic waxes. The particularly preferred are hard polymer waxes which have high affinity for solvent, are superior in thermal dispersion stability, and which are free of stickiness, such as polyethylene waxes and acrylic waxes which are most suitable for controlling spreading indices.

The polyethylene and polypropylene waxes have a number average molecular weight of from 1,000 to 20,000, preferably from 1,000 to 10,000. The number average molecular weight of acrylic wax is from 5,000 to 5,000,000, preferably from 10,000 to 3,000,000, and more preferably from 100,000 to 2,000,000.

As one of the three essential components constituting the surface coating layer, an aqueous resin or a resin soluble in organic solvent is used.

The aqueous resin is a water soluble and/or water dispersible resin which is exemplified by polymer materials such as polyvinyl alcohol, ion denatured polyvinyl alcohol, polyethylene oxide, polyvinyl pyrrolidone, polyurethane, blocked isocyanate-containing urethane oligomer, starch, gelatin, casein, carboxymethylcellulose, hydroxyethylcellulose, copolymerized polyester, polyacrylic acid, acrylic acid copolymer and polyvinyl acetate. The resin soluble in organic solvent dissolves in a single or combined solvent of toluene, methyl ethyl ketone and ethyl acetate, and is exemplified by copolymerized polyester, polyurethane, acrylic copolymer and styrene-butadiene copolymer, which may be used alone or in combination where necessary.

It is particularly preferable to use aqueous resins from the aspects of sanitary safety and workability.

The content of the above-mentioned inorganic particles relative to the aqueous resin or resin soluble in organic solvent is preferably 25–250 parts by weight, more preferably 65–150 parts by weight, of the inorganic particles per 100 parts by weight of the aqueous resin or resin soluble in organic solvent, when converted to solids. When the content of the inorganic particles is less than 25 parts by weight, the film tends to absorb less amount of the ink, and when it exceeds 250 parts by weight, scratch resistance of the surface coating layer tends to decrease.

The content of the above-mentioned polymer wax relative to the aqueous resin or resin soluble in organic solvent is preferably 0.1–5.0 parts by weight, more preferably 0.5–1.5 parts by weight, of the polymer wax per 100 parts by weight of the aqueous resin or resin soluble in organic solvent, when converted to solids. When the content of the polymer wax is less than 0.1 part by weight, the ink tends to spread more and when it exceeds 5.0 parts by weight, the ink tends to be absorbed less.

The surface coating layer containing the above-mentioned three components as essential components may contain various additives such as cross-linking agents (e.g., melamine and isocyanate agents) and antistatic agents to enhance additional functions as necessary as the outermost layer of the surface-treated plastic film, such as scratch resistance, antistatic property and water resistance. Of the antistatic agents, the use of, for example, inorganic antistatic agent such as Zn—Sn compounds, titanic acid compounds and phosphoric compounds or polymer antistatic agent is preferable, since organic low molecular weight antistatic agents tend to increase spreading of the ink by aiding diffusion thereof.

The thickness of the surface coating layer is preferably not less than 0.1 μm. When it is less than 0.1 μm, the ink tends to be absorbed insufficiently. Considering the cost merit and the like, the range of from 0.5 μm to 5.0 μm is more preferable.

The plastic film to be used in the present invention is not particularly limited, and is exemplified by polymer films prepared from, for example, one or more kinds of polyolefine, polyester, polyamide, polyimide, polycarbonate, polystyrene, polymethyl-methacrylate, polyvinyl chloride, polyvinylidene chloride and polyvinylidene fluoride. Particularly preferred are polyester films.

While the thickness of the plastic film is not particularly limited, it is preferably 1–5,000 μm, more preferably 5–500 μm, to secure general strength as a synthetic paper.

The polyester preferably used as the material of the plastic film is, for example, a polyester prepared by condensation polymerization of aromatic dicarboxylic acid such as terephthalic acid, isophthalic acid and naphthalene dicarboxylic acid or ester thereof, and glycol such as ethylene glycol, diethylene glycol, 1,4-butanediol and neopentyl glycol.

Said polyester can be also prepared by direct reaction of aromatic dicarboxylic acid and glycol, ester exchange of alkyl ester of aromatic dicarboxylic acid and glycol, followed by condensation polymerization, or condensation polymerization of diglycol ester of aromatic dicarboxylic acid.

Specific examples of the above-mentioned polyester include polyethylene terephthalate, polybutylene terephthalate and polyethylene-2,6-naphthalate. The polyester may be a homopolymer or a copolymerized polymer of two or more kinds of acid component and/or glycol component.

In the present invention, a polyester is preferable which comprises ethylene terephthalate unit, butylene terephthalate unit or ethylene-2,6-naphthalate unit in a proportion of not less than 70% by mol, preferably not less than 80% by mol, and more preferably not less than 90% by mol. The selective use of such polyester as a material of the plastic film leads to a surface-treated plastic film having more superior dimensional stability and heat resistance.

Furthermore, a polyester film having fine voids which is capable of making the apparent specific gravity of the surface-treated plastic film 0.8–1.3 is particularly preferable as a plastic film to be used in the present invention, which polyester film is obtained by using a film material comprising a polyester and one or more thermoplastic resins incompatible with the above-mentioned polyester, forming the material into a film, and applying at least monoaxial drawing, preferably biaxial drawing in the lengthwise and crosswise directions, to the film by the method to be mentioned later to form a multitude of fine voids inside the film.

The thermoplastic resin incompatible with the polyester is added as a void forming agent to form fine voids in the polyester film for an improved flexibility, light-weightedness and image drawability, and is subject to no particular limitation as long as it is incompatible with the polyester. Due to the incompatible property of the thermoplastic resin, it disperses in the polyester in a fine particulate state to form voids in the interface with the polyester upon drawing.

Examples of the thermoplastic resin include polystyrene resins such as isotactic polystyrene, syndiotactic polystyrene, atactic polystyrene, styrene-butadiene copolymer, acrylonitrile-butadiene-styrene copolymer and high impact polystyrene (mixture of styrene and olefin rubber), polyphenylene ether resins, polyolefine resins (e.g., polymethylpentene, polypropylene, polyethylene and cyclic olefin polymer), polyacrylic resins, polycarbonate resins, polysulfonic resins, and cellulose resins. Particularly preferred are polystyrene resins and polyolefine resins (e.g., polymethylpentene and polypropylene).

The amount of the thermoplastic resin to be added to the polyester varies depending on the desired amount of void to be formed in the plastic film and drawing conditions. It is preferably 3–40% by weight, particularly preferably 5–15% by weight, relative to the entire plastic film. When it is less than 3% by weight, the amount of void formed is limited, so that the flexibility, light-weightedness and image drawability afforded by the void formation tend to be difficult to achieve. On the other hand, when it exceeds 40% by weight, drawability tends to decrease and heat resistance, strength and nerve possessed by the plastic film tend to be impaired. The thermoplastic resin may be used alone or in combination.

The plastic film to be used in the present invention may contain inorganic particles or organic particles where necessary for an improved hiding property and image drawability. Examples of the inorganic particles include silica, kaolinite, talc, calcium carbonate, zeolite, alumina, barium sulfate, carbon black, zinc oxide and titanium dioxide. Examples of the organic particles include particles of organic white pigment, benzoguanamine, crosslinked polystyrene and crosslinked acrylic resin.

In the present invention, the plastic film may be a monolayer film or a composite film having two or more layers.

The method for preparing the composite film is not particularly limited. In view of the productivity and the like, it is most preferably prepared by coextrusion laminating comprising extruding the materials of the respective layers from different extruders, leading the extruded materials to one die to give an undrawn film and orienting the film at least monoaxially.

The surface-treated plastic film of the present invention has, on at least one surface of a plastic film, the above-mentioned surface coating layer comprising, as essential components, inorganic particles subjected to organic surface treatment and/or inorganic surface treatment, a polymer wax, and an aqueous resin or resin soluble in organic solvent.

In particular, the surface-treated plastic film comprising the above-mentioned film having fine voids has an apparent specific gravity of from 0.8 to 1.3, preferably from 1.0 to 1.25, and more preferably from 1.05 to 1.25. When the specific gravity is less than 0.8, the void content becomes too great to result in insufficient strength of the surface-treated plastic film, and cracks and wrinkles on the surface of the surface-treated plastic film. Conversely, when the apparent specific gravity exceeds 1.3, the void content tends to be insufficient and cushioning property, flexibility and image drawability are impaired.

The apparent specific gravity can be controlled by varying the kind and amount of void forming agent, or the kind and amount of the thermoplastic resin incompatible with polyester, and film forming conditions, particularly the drawing conditions.

The apparent specific gravity is determined as follows.

A surface-treated plastic film is precisely cut out in 5.00 cm×5.00 cm square. The thickness is measured at 50 points to obtain an average thickness (t $\mu$m); and the film is weighed to 0.1 mg and expressed as W g. The apparent specific gravity is calculated from the following equation.

$$\text{Apparent specific gravity} = w \times 10^4/(5 \times 5 \times t)$$

The surface-treated plastic film of the present invention comprising a plastic film with or without fine voids preferably has a light permeability of not more than 30% and an inplane birefringence of not less than −0.02 and not more than +0.04.

The surface-treated plastic film of the present invention preferably has a light permeability of not more than 30%, more preferably not more than 20%, and most preferably not more than 15%, to enhance its adaptability as a synthetic paper. When the light permeability exceeds 30%, the back of the film can be seen through to impair the appearance of the printed matters.

The light permeability can be adjusted by varying the fine void content and the amount of the particles to be added.

The light permeability is determined by measuring a light permeability through the surface-treated plastic film according to JIS-K6714 using a Poyic integral spherical H.T.R meter (manufactured by Nippon Seimitsu Kogaku).

The surface-treated plastic film of the present invention preferably has an inplane birefringence of not less than −0.02 and not more than +0.04, more preferably from 0 to +0.03. The film having an inplane birefringence of not less than −0.02, preferably not more than 0, is substantially isotropic and hard to tear in the transverse direction of the film. When the inplane birefringence exceeds +0.04, however, the film easily tears in the lengthwise direction of the film, which results in breakage upon slitting of the film and lengthwise tearing of the film upon cutting. When the inplane birefringence is less than −0.02 or above +0.04, the film tends to have wrinkles and curling upon printing using a printer.

For the inplane birefringence to be plus (+) or minus (−) means that the hysteresis of lengthwise drawing remains in a greater or less degree than that of the crosswise drawing hysteresis. The inplane birefringence may accompany a slight inclination of the principal axis, which is caused by a so-called bowing phenomenon upon crosswise drawing.

The inplane birefringence is determined as in the following.

A surface-treated plastic film is cut out in 10.00 cm ×10.00 cm, and weighed (W g). The substantial thickness (T cm) which is irrelevant to the void content is calculated from the following equation using the density ρ (g/cm$^3$) obtained when the film does not have voids inside.

$$T=W/(\rho\times100)$$

Then, using a molecular orientation meter MOA-2001A manufactured by Kanzaki Paper MFG Co., Ltd. and the thickness T obtained above, the refractive indices in the microwave region along lengthwise principal axis and transverse principal axis are determined. According to the following equation, the inplane birefringence is calculated.

Inplane birefringence=refractive index along lengthwise principal axis−refractive index along transverse principal axis The density ρ is calculated from the composition ratio of each component constituting the surface-treated plastic film and the density of the components.

The method for producing the plastic film to be used in the present invention is not particularly limited. In particular, the above-mentioned film containing fine voids can be prepared by drawing an undrawn film prepared from a mixture of polyester and thermoplastic resin incompatible with the polyester monoaxially in the lengthwise direction of the film, preferably by multiple step drawing 3.0 times or more, relaxing the film in the lengthwise direction of the film by not less than 3%, then crosswisely drawing the film at a draw ratio not less than the lengthwise draw ratio after the relaxation treatment, and heat treatment.

In the first lengthwise drawing, the film is lengthwisely drawn in the running direction of the film while heating as appropriate in between two or more rolls having different rolling speeds. The heating in this step may be performed by, for example, using heated rolls or heating the rolls by hot air, radiation heat and the like without direct contact with the rolls, which methods may be used in combination.

It is preferable to set the lengthwise drawing temperature at (Tg+10)° C.–(Tg+50)° C. wherein Tg is the glass transition temperature of polyester and the draw ratio of not less than 3.0, preferably 3.2–5.0, so that the polyester and the thermoplastic resin incompatible with the polyester can be separated from each other in the interface in this lengthwise drawing step to allow efficient emergence of voids in the film. When the lengthwise draw ratio is less than 3.0, fine voids cannot be formed sufficiently in the film, and therefore it may be difficult to make the apparent specific gravity of the final product of the surface-treated plastic film not more than 1.3. When the lengthwise draw ratio exceeds 5, the subsequent relaxation tends to be insufficient, which in turn makes it substantially difficult to adjust the inplane birefringence of the surface-treated plastic film not more than 0.04.

After the lengthwise drawing, a relaxation treatment by 3% or more, preferably 5% or more, in the lengthwise direction follows. The more preferable relaxation ratio varies depending on the draw ratio of the lengthwise drawing preceding the relaxation. The relaxation ratio is preferably set such that the lengthwise draw ratio after the relaxation becomes 2.8–3.5.

When the relaxation ratio is set to not less than 3%, an industrially stable production of the surface-treated plastic film having an inplane birefringence of −0.02–+0.04 becomes realizable. In contrast, a relaxation ratio of less than 3% may noticeably degrade the crosswise drawing performance in the next step, making preparation of the film having an inplane birefringence of −0.02–+0.04 difficult. A surface-treated plastic film prepared using a film having a less fine void content and having an apparent specific gravity exceeding 1.3 is capable of achieving an isotropy without such relaxation treatment. However, a light-weighted, flexible and image drawable film having fine voids and a lower specific gravity, such as the above-mentioned film, can be obtained through the above-mentioned relaxation treatment.

As mentioned earlier, the preferable lengthwise draw ratio after the lengthwise relaxation is from 2.8 to 3.5. When the lengthwise draw ratio is less than 2.8, the relaxation tends to become insufficient and nonuniform. Consequently, a uniform film may not be obtained and the inplane birefringence of the final product of the surface-treated plastic film tends to be less than −0.02. In contrast, when the lengthwise draw ratio after the relaxation exceeds 3.5, the drawing during a crosswise drawing tends to be defective and the inplane birefringence of the surface-treated plastic film tends to easily exceed +0.04.

The relaxation is done by, for example, a method comprising once cooling the lengthwisely drawn film and re-heating same to about 80°–150° C. in a heating device such as an oven, a method comprising re-heating, for relaxation treatment, the film between rolls without cooling immediately after the lengthwise drawing, a method comprising relaxation treatment between a group of driven rolls or free rolls heated to about 60°–100° C., and a method combining these methods as appropriate. Of these relaxation treatment methods, the most preferred is the method comprising a relaxation treatment without cooling immediately after the lengthwise drawing, and this method accompanies less heat loss and enables more uniform and efficient relaxation treatment.

After the above-mentioned relaxation treatment, the film is led to a tenter and subjected to crosswise drawing at a ratio not less than the lengthwise draw ratio after the relaxation treatment. The preferable crosswise drawing temperature is not less than the highest temperature during the lengthwise drawing and relaxation treatment and not more than (Tm-10)° C. wherein Tm is a melting point of the polyester. When the crosswise draw ratio is smaller than the lengthwise draw ratio after the relaxation treatment, the inplane birefringence of the obtained surface-treated plastic film may not be easily adjusted to not more than +0.04. While the upper limit of the crosswise draw ratio is not particularly set, it is preferably not more than (lengthwise draw ratio after relaxation treatment+1.0), whereby the inplane birefringence of the ultimately obtained surface-treated plastic film can be certainly made not less than −0.02.

The biaxially stretched film thus obtained is subjected to a heat treatment on demand. The heat treatment is preferably applied in a tenter at a temperature of (Tm-50)–Tm° C. A crosswise redrawing and crosswise relaxation may be applied in parallel with this heat treatment.

The method for preparing the surface-treated plastic film of the present invention, namely, a method for forming a surface coating layer on a plastic film for an improved writability and printability is generally a coating method, such as gravure coating method, kiss coating method, dipping method, spray coating method, curtain coating method, air knife coating method, blade coating method and reverse roll coating method.

Such coating layer may be formed before the drawing of the plastic film, after the lengthwise drawing or after orientation, which is optionally selected. The most preferred for enhancing the adhesion between the plastic film and the surface coating layer is an in-line coating including applying a coating solution on at least one surface of the monoaxially drawn plastic film by the above-mentioned coating method, and drawing the film in the direction forming a right angle with the direction of the previous monoaxial drawing.

The surface-treated plastic film of the present invention thus obtained suffers less from spreading of aqueous and alcohol inks as compared to conventional plastic films practically used as synthetic papers, is superior in image drawability and printability, is excellent in writability with aqueous ink pens and acceptability of stamp inks and vermilion inks for sealing stamps, is superior in sailing through various printers, adhesion of various inks used for various printings, such as solvent type ink, aqueous type ink and UV curing type ink, and shows an improved adhesion of toners for bar cord labels and the like. Accordingly, the film of the present invention exhibits extremely superior performance as, for example, various labels, bar cord labels, delivery slips, paper for various printers and information recording papers.

The ink jet recording material of the present invention can be obtained by using a surface-treated plastic film comprising, at least on one surface of a plastic film, a surface coating layer wherein the spreading index of aqueous and alcohol inks on the surface-treated plastic film at the surface coating layer side is 1.0–1.2, respectively, preferably by using a surface-treated plastic film wherein the surface coating layer comprises, as essential components, inorganic particles subjected to organic surface treatment and/or inorganic surface treatment, a polymer wax, and an aqueous resin or resin soluble in organic solvent. That is, the ink jet recording material of the present invention comprises an ink receiving layer formed on the surface coating layer of the surface-treated plastic film having the above-mentioned surface coating layer. The use of such surface coating layer enables production of an ink jet recording material which suffers less from spreading of inks and shows fine adhesion between the ink receiving layer and the surface-treated plastic film.

The resin component constituting the ink receiving layer is not particularly limited as long as it absorbs inks. Examples thereof include polyvinyl alcohol, acrylic resin, styrene-acryl copolymer, ethylenevinyl acetate copolymer, starch, polyvinyl butyral, gelatin, casein, ionomer, gum arabic, carboxymethylcellulose, polyvinyl pyrrolidone, polyacrylamide, polyester, phenolic resins, melamine resins, epoxy resins and styrene-butadiene rubber, from which one or more kinds may be used.

Such ink receiving layer preferably contains melamine resins, epoxy resins or polyurethane resins having an isocyanate group, by which the ink receiving layer comes to have a higher hardness to show better-water resistance.

The thickness of the ink receiving layer is not particularly limited and is preferably 3–50 μm, more preferably 5–25 μm.

The ink receiving layer may contain particles such as silica, kaolinite, talc, calcium carbonate, zeolite, alumina, barium sulfate, carbon black, zinc oxide and titanium oxide, organic white pigment, benzoguanamine, crosslinked polystyrene, crosslinked acrylic resin and aluminum hydroxide.

For forming the ink receiving layer, a conventional method such as gravure coating method, kiss coating method, dipping method, spray coating method, curtain coating method, air knife coating method, blade coating method or reverse roll coating method may be employed.

The present invention is described in more detail in the following by illustrative Examples. The present invention is not subject to any limitation by the following Examples, and the invention can be adequately modified and practiced within the scope commensurate with the scope of the foregoing and subsequent descriptions. All such modified applications are entirely encompassed in the technical scope of the present invention.

The methods for the determination and evaluation employed in the following Examples with regard to various properties and performances are as follows.

(1) Intrinsic viscosity of film material

A resin to be the film material is dissolved in a mixed solvent of phenol (6 parts by weight) and tetrachloroethane (4 parts by weight) and the intrinsic viscosity thereof is measured at 30° C.

(2) Ink spreading index

An aqueous ink (Replenish ink:vermilion exclusively for Bando stamps, manufactured by Bando Corp., which was available as of Jan. 1, 1995) or an alcohol ink (Shachihata stamp replenish ink: S–1 black, manufactured by Shachihata Kogyo Kabushiki Kaisha., which was available as of Jan. 1, 1995) is measured (0.6 μm) with a microsyringe and dropwise placed on the surface of the sample film (surface coating layer side) previously set on a sample table of a stereoscopy (Nikon UFX) equipped with a camera. The area ($S_1$) where the ink is adhered just after the dropwise placing and the area ($S_2$) after 30 minutes are determined from the photographs taken under the same conditions. Using $S_1$ and $S_2$ thus obtained with respect to the aqueous and alcohol inks, the ratio of the ink adhesion areas is determined from the following equation and taken as an ink spreading index of the aqueous or alcohol ink:

$$\text{ink spreading index}=S_2/S_1$$

(3) Printability

Using a sheet offset printer (RICOH auto printer AP3700, manufactured by RICOH) and oxidation polymerization type ink (GRAF-G Chinese ink, Dainippon ink Inc.), respective sample films are actually printed on the surface coating layer side, and the building of the contact part is visually observed. The state where the ink has been uniformly transferred and free of spot is expressed by ⊖ and the state where the transfer spot of the ink is observed and the ink is thin is expressed by X .

(4) Writability with aqueous ink ballpoint pen

Notes are taken on the sample film using an aqueous ink ballpoint pen (Mitsubishi Uniball/VB106Z, manufactured by Mitsubishi Pencil Co., Ltd.), and the spreading of the written letters after 16 hours is visually observed. When the written letters are readable, the film is expressed by ⊖ and when unreadable, by X.

The writing feeling during taking notes is evaluated by drawing straight lines and curved lines. The sheet which allows smooth drawing without scratches is expressed by ⊖.

(5) Apparent specific gravity

A surface-treated plastic film is precisely cut out in 5.00 cm×5.00 cm square. The thickness is measured at 50 points to obtain an average thickness (t μm), and the film is weighed to 0.1 mg and expressed as W g. The apparent specific gravity is calculated from the following equation.

$$\text{Apparent specific gravity}=w\times10^4/(5\times5\times t)$$

(6) Light permeability

The light permeability is determined by measuring light permeability through the film according to JIS-K6714 using a Poyic integral spherical H.T.R meter (manufactured by Nippon Seimitsu Kogaku). The smaller values indicate higher hiding power.

(7) Curling by heat

An anchor layer having the following composition is formed on the surface coating layer of the surface-treated plastic film, an image receiving layer having the following composition is formed thereon, and an image from a VCR is actually printed out from a color printer (D-SCAN CH–5504, manufactured by Seiko Instruments Inc.). When a curling is not found in the printed-out product, the film is evaluated as ⊖ and when it is found, the film is evaluated as X.

Anchor layer

An anchor layer is formed by applying a copolymerized polyester having sulfonic acids [VYLONAL MD 1200 aqueous dispersion (10%), manufactured by Toyo Boseki Kabushiki Kaisha] with a wire bar #5 and drying.

Image receiving layer

An image receiving layer is formed by applying a styrene copolymerized acrylic emulsion [ACRYSET® aqueous dispersion (10%), manufactured by NIPPON SHOKUBAI CO., LTD.] with a wire bar #5 and drying.

(8) Adhesion of surface coating layer The surface coating layer of the surface-treated plastic film is cross-cut at 2 mm pitch, and 90° peeling test is performed using a cellophane tape (25 mm width, manufactured by NICHIBAN COMPANY, LIMITED). The adhesion is evaluated from the area ratio of the residual surface coating layer in the cross-cut area.

(9) Inplane birefringence

A surface-treated plastic film is cut into a 10 cm×10 cm film and weighed (weight: W g). Using the density ρ (g/cm$^3$) obtained when the film does not have voids inside, a substantial thickness T (cm) of the film, which is irrelevant to the void content, is obtained from the following equation.

$$T=W/(\rho\times100)$$

Then, using a molecular orientation meter MOA-2001A manufactured by Kanzaki Paper MFG Co., Ltd., and the thickness T obtained above, refractive index in the microwave region is determined along the lengthwise principal axis and crosswise principal axis. Using these values, inplane birefringence is calculated from the following equation:

Inplane birefringence=refractive index along lengthwise principal axis−refractive index along crosswise principal axis Note that the density p is calculated from the composition of the respective compositions constituting the surface-treated plastic film and the density thereof.

(10) Ink adhesion

The adhesion of the ink is evaluated by the following method. An oxidation polymerization type ink is printed on the surface coating layer of the surface-treated plastic film with a Tetoron screen (#250 mesh), left standing for 16–24 hours, and cross-cut at 2 mm pitch, which film is subjected to 900 peeling test using a cellophane tape (25 mm width, manufactured by NICHIBAN COMPANY, LIMITED). The ink is evaluated in the same manner as above. The evaluation results are as follows.

⊖ fine (remaining 90% or more of ink or cleavage of plastic film)

Δ rather poor (remaining 70% or above and less than 90% ink)

EXAMPLE 1

A water dispersible copolymerized polyester resin (A) (VIRONAL MD 1200, manufactured by Toyo Boseki Kabushiki Kaisha as a resin component, copolymerized polyester containing sulfonic acid, molecular weight about 15,000), silica particles (B) (average particle size 3.5 μm, manufactured by FUJI SILYSIA CHEMICAL LTD.) subjected to surface inorganic treatment with magnesium treating agent, and synthetic polymer wax agent (C) (CX-ST200, manufactured by NIPPON SHOKUBAI CO., LTD., acrylic wax, molecular weight 1,000,000–2,000,000) were used. The silica particles (B) were thoroughly dispersed in a mixed solution of water and isopropyl alcohol (weight ratio 80/20) in a homogenizer. Then, resin (A) and synthetic polymer wax agent (C) were added, which was followed by thorough mixing to give a coating solution containing resin (A) (5.0 wt %), silica particles (B) (5.0 wt %) and synthetic polymer wax agent (C) (0.05 wt %) in the respective ratios relative to the total weight of the coating solution. This coating solution was applied on a 50 μm thick polyester (polyethylene terephthalate) film with a wire bar #5. The coating solution was applied in an amount of about 10 g (wet state) per 1 m$^2$ of the plastic film. After coating, the film was dried at 160° C. for about 60 seconds to give a surface-treated plastic film having a surface coating layer (1 g/m$^2$).

The properties of the thus obtained surface-treated plastic film were as shown in Table 1. The printability of the film was fine with the spreading index of the aqueous and alcohol inks being 1.0. The film was extremely superior without ink spreading during taking notes with an aqueous ink ballpoint pen and with fine writing feeling.

TABLE 1

| | Ink spreading index | | Printability (ink | Aqueous ink ballpoint pen | | Apparent | Light permeability | | Adhesion of coating | Inplane birefringence | Ink |
|---|---|---|---|---|---|---|---|---|---|---|---|
| | aqueous ink | alcohol ink | adhesion) | writing feeling | ink spreading | specific gravity | (%) | Curling | layer (%) | | adhesion |
| Ex. 1 | 1.0 | 1.0 | ○ | ○ | ○ | 1.40 | 80 | X | 80 | −0.03 | ○ |
| Ex. 2 | 1.0 | 1.1 | ○ | ○ | ○ | 1.40 | 80 | X | 86 | −0.03 | ○ |
| Ex. 3 | 1.0 | 1.0 | ○ | ○ | ○ | 1.20 | 13 | ○ | 78 | +0.02 | ○ |
| Ex. 4 | 1.0 | 1.1 | ○ | ○ | ○ | 1.20 | 13 | ○ | 84 | +0.02 | ○ |
| Ex. 5 | 1.0 | 1.0 | ○ | ○ | ○ | 1.20 | 13 | ○ | 100 | +0.02 | ○ |
| Ex. 6 | 1.0 | 1.1 | ○ | ○ | ○ | 1.20 | 13 | ○ | 100 | +0.02 | ○ |
| Ex. 7 | 1.0 | 1.0 | ○ | ○ | ○ | 1.40 | 80 | X | 80 | −0.03 | ○ |
| Ex. 8 | 1.0 | 1.1 | ○ | ○ | ○ | 1.20 | 13 | ○ | 100 | +0.02 | ○ |
| Comp. Ex. 1 | 2.1 | 2.3 | ○ | ○ | X | 1.40 | 80 | X | 84 | −0.03 | ○ |
| Comp. | 1.5 | 2.2 | ○ | ○ | X | 1.40 | 80 | X | 88 | −0.03 | ○ |

TABLE 1-continued

| | Ink spreading index | | Printability (ink | Aqueous ink ballpoint pen | | Apparent | Light permea- | | Adhesion of coating | Inplane bire- | Ink |
|---|---|---|---|---|---|---|---|---|---|---|---|
| | aqueous ink | alcohol ink | adhesion) | writing feeling | ink spreading | specific gravity | bility (%) | Curling | layer (%) | fringence | adhesion |
| Ex. 2 | | | | | | | | | | | |
| Comp. Ex. 3 | 2.2 | 2.5 | ○ | ○ | X | 1.20 | 13 | ○ | 82 | +0.02 | ○ |
| Comp. Ex. 4 | 1.8 | 2.1 | ○ | ○ | X | 1.20 | 13 | ○ | 90 | +0.02 | ○ |
| Comp. Ex. 5 | less then 1.0 for both* | | X | writing not possible | | 1.40 | 90 | X | 83 | −0.03 | Δ |

Note *: occurrence of repelling of ink

EXAMPLE 2

In the same manner as in Example 1 except that particles subjected to organic surface treatment by spray coating of saturated hydrocarbon spray wax were used instead of silica particles (B), a coating solution was prepared and a surface-treated plastic film was obtained.

EXAMPLE 3

In the same manner as in Example 1 except that a polyester film having fine voids which was prepared by the following method was used as a plastic film, a surface-treated plastic film was obtained.

Preparation of plastic film

Polyethylene terephthalate resin (80 wt %) having an intrinsic viscosity of 0.62, polystyrene for general use (T575–57U, manufactured by Mitsui Toatsu Chemicals, Inc., 15 wt %) and anatase-type titanium dioxide having an average particle size of 0.35 μm (TA-300, manufactured by Fuji Titan Corp., 5 wt %) were used as starting materials, and cast into a biaxial screw extruder for uniform mixing. The mixture was melt-extruded from a T-die at 290° C. and solidified by cooling on static adhesion to a cooling rotation roll, whereby an undrawn sheet having a thickness of about 1100 μm was obtained. Then, this undrawn sheet was drawn 3.7 times in the lengthwise direction of the sheet by a roll drawing machine at 80° C., subjected to relaxation to make the substantial draw ratio 3.2, crosswisely drawn 3.0 times by a tenter at 125° C., and crosswisely drawn 1.5 times by a tenter at 220° C. The film was subjected to heat treatment with relaxation by 4% at 235° C. and cooled to give a 100 μm thick polyester film having a multitude of fine voids inside.

EXAMPLE 4

In the same manner as in Example 2 except that a polyester film having a multitude of fine voids which was prepared in the same manner as in Example 3 was used as a plastic film, a surface-treated plastic film was obtained.

EXAMPLE 5

In the same manner as in Example 1, a coating solution was prepared by thoroughly mixing resin (A) (same as in Example 1, 10 wt %), silica particles (B) (same as in Example 1, 10 wt %) subjected to inorganic surface treatment, and synthetic polymer wax agent (C) (same as in Example 1, 0.10 wt %).

Polyethylene terephthalate resin (80 wt %) having an intrinsic viscosity of 0.62, polystyrene for general use (T575–57U, manufactured by Mitsui Toatsu Chemicals, Inc., 15 wt %) and anatase-type titanium dioxide having an average particle size of 0.35 μm (TA-300, manufactured by Fuji Titan Corp., 5 wt %) were used as starting materials, and cast into a biaxial screw extruder for uniform mixing. The mixture was melt-extruded from a T-die at 290° C. and solidified by cooling on static adhesion to a cooling rotation roll, whereby an undrawn sheet having a thickness of about 1100 μm was obtained. Then, this undrawn sheet was drawn 3.7 times in the lengthwise direction of the sheet by a roll drawing machine at 80° C., and subjected to relaxation to make the substantial draw ratio 3.2, whereby a monoaxially drawn film was obtained.

This monoaxially drawn film was coated with the above-mentioned coating solution with a wire bar #14, so that the thickness after drying became 5 g/m$^2$. The film was crosswisely drawn 3.0 times at 125° C. and then 1.5 times at 220° C. by a tenter. The film was subjected to heat treatment with relaxation by 4% at 235° C. and then cooling to give an about 100 μm thick surface-treated plastic film having a multitude of fine voids inside the plastic film.

EXAMPLE 6

In the same manner as in Example 5 except that particles subjected to organic surface treatment by spray coating of saturated hydrocarbon spray wax were used instead of silica particles (B), a coating solution was prepared and a surface-treated plastic film was obtained.

The property evaluation of the surface-treated plastic films obtained in the above Examples 2–6 is shown in Table 1. The films having approximately the same fine properties as the film obtained in Example 1 were obtained.

EXAMPLE 7

A copolymerized polyester resin (A) (VYRON RV–200, manufacture by Toyo Boseki Kabushiki Kaisha, molecular weight about 20,000) soluble in organic solvent as a resin component, silica particles (B) (average particle size 3.5 μm, manufactured by FUJI SILYSIA CHEMICAL LTD.) subjected to inorganic surface treatment (magnesium treatment), and synthetic polymer wax agent (C) (CX-ST200, manufactured by NIPPON SHOKUBAI CO., LTD., acrylic wax, molecular weight 50,000–1,200,000) were used. First, silica particles (B) were thoroughly dispersed in a mixed solution of toluene and methyl ethyl ketone (weight ratio 60/40) in a homogenizer. Then, resin (A) and synthetic polymer wax agent (C) were added, which was followed by thorough mixing in the solvent to give a coating solution containing resin (A) (5.0 wt %), silica particles (B) (5.0 wt %) and synthetic polymer wax agent (C) (0.05 wt %) in the respective ratios relative to the total weight of the coating solution. This coating solution was applied on a 50 μm thick polyethylene terephthalate film with a wire bar #5. After coating, the film was dried at 160° C. for about 60 seconds to give a surface-treated plastic film having a surface coating layer (thickness about 1 g/m$^2$).

The properties of the thus obtained surface-treated plastic film were as shown in Table 1. The printability of the film was fine with the spreading index of the aqueous and alcohol inks being 1.0. The film was extremely superior with fine writing feeling and without spreading of the ink during taking notes with an aqueous ink ballpoint pen.

EXAMPLE 8

In the same manner as in Example 1 except that a polyester film having a multitude of fine voids which was prepared in the same manner as in Example 3 was used as a plastic film, and the resin component in Example 1 was changed to a mixture of a water dispersible copolymerized polyester resin (A) (VYRONAL MD-16, manufacture by Toyo Boseki Kabushiki Kaisha) and thermally reactive water soluble urethane resin (B) (ELASTRON H-38, manufactured by Daiichi Kogyo Seiyaku) havining blocked isocyanate group, in a solid weight ratio-converted proportion of (A)/(B)=1/1, a surface-treated plastic film was obtained.

The properties of the thus obtained surface-treated plastic film were as shown in Table 1, and the approximately the same fine results as the film of Example 6 were obtained.

COMPARATIVE EXAMPLE 1

In the same manner as in Example 1 except that synthetic polymer wax agent (C) was omitted and surface untreated silica particles were used instead of silica particles (B), a surface-treated plastic film was obtained.

The properties of the thus obtained film were as shown in Table 1. The printability of the surface was fine, but spreading indices of aqueous and alcohol inks were insufficient. While the writing feeling with an aqueous ink ballpoint pen was fine, the ink spread markedly to make the lines blurred.

COMPARATIVE EXAMPLE 2

In the same manner as in Example 2 except that synthetic polymer wax agent (C) was omitted, a surface-treated plastic film was obtained.

The properties of the thus obtained film were as shown in Table 1. The printability of the treated surface was fine, but spreading indices of aqueous and alcohol inks were insufficient. While the writing feeling with an aqueous ink ballpoint pen was fine, the ink showed a high spreading index and the film was unsatisfactory.

COMPARATIVE EXAMPLE 3

In the same manner as in Example 3 except that synthetic polymer wax agent (C) was omitted, a surface-treated plastic film was obtained.

The properties of the thus obtained film were as shown in Table 1. The printability of the treated surface was fine, but spreading indices of aqueous and alcohol inks were insufficient. While the writing feeling with an aqueous ink ballpoint pen was fine, the ink showed a high spreading index and the film was unsatisfactory.

COMPARATIVE EXAMPLE 4

In the same manner as in Example 4 except that synthetic polymer wax agent (C) was omitted, a surface-treated plastic film was obtained.

The properties of the thus obtained film were as shown in Table 1. The printability of the surface was fine, but spreading indices of aqueous and alcohol inks were insufficient. While the writing feeling with an aqueous ink ballpoint pen was fine, the ink showed a high spreading index and the film was unsatisfactory.

COMPARATIVE EXAMPLE 5

In the same manner as in Example 1 except that silica particles subjected to inorganic surface treatment were omitted, a surface-treated plastic film was obtained.

The properties of the thus obtained film were as shown in Table 1. The ink spreading index of the film was less than 1.0, which caused repelling of the ink. The printability of the surface was defective, and notes could not be taken with an aqueous ink ballpoint pen.

EXAMPLES 9–13

An ink receiving layer solution prepared by dissolving polyvinyl alcohol (PVA117, manufactured by KURARAY CO., LTD., 20 parts by weight), polyurethane resin (ELASTRON H-38, manufactured by Daiichi Kogyo Seiyaku, 10 parts by weight) having blocked isocyanate group, and spherical silica particles (20 parts by weight) having an average particle size of 2.5 μm, in water (230 parts by weight), was coated on the surface coating layer of the surface-treated plastic films of Examples 1 and 3–6, with a wire bar, so that the thickness after drying became 16 g/m$^2$, whereby an ink jet recording material was obtained.

Using Design jet HP-650 C (manufactured by Hewlett-Packard Company), a map was printed on said ink jet recording material. The narrow lines showed no spreading, and the map showed brilliant colors. A cellophane tape (25 mm width, manufactured by NICHIBAN COMPANY, LIMITED) was adhered to the ink receiving layer and peeled off quickly. The ink receiving layer did not come off.

The surface-treated plastic film of the present invention having respective spreading indices of aqueous and alcohol inks of 1.0–1.2 allows less spreading of the aqueous ink of ballpoint pens, is superior in writability and offset printability, and is extremely useful as a synthetic paper. In addition, the use of such surface-treated plastic film enables production of an ink jet recording material permitting high grade recording.

What is claimed is:

1. A surface-treated plastic film comprising a surface coating layer formed on at least one surface of a plastic film, which has a spreading index of aqueous inks of 1.0–1.2 and a spreading index of alcohol inks of 1.0–1.2 at the surface coating layer side thereof, said surface coating layer comprising inorganic particles subjected to organic surface treatment and/or inorganic surface treatment, a polymer wax, and an aqueous resin or a resin soluble in organic solvent.

2. The surface-treated plastic film of claim 1, wherein the plastic film is a polyester film.

3. The surface-treated plastic film of claim 2, wherein the plastic film has an apparent specific gravity of 0.8–1.3 and the polyester film comprises a polyester and one or more thermoplastic resins incompatible with said polyester, said polyester film having fine voids formed by drawing in at least a monoaxial direction.

4. A surface-treated plastic film comprising a surface coating layer formed on at least one surface of a plastic film, which has a spreading index of aqueous inks of 1.0–1.2 and a spreading index of alcohol inks of 1.0–1.2 at the surface coating side thereof, said surface coating layer comprising inorganic particles subjected to organic surface treatment and/or inorganic surface treatment, a polymer wax, and an aqueous resin.

5. The surface-treated plastic film of claim 4, wherein the plastic film is a polyester film.

6. The surface-treated plastic film of claim 5, wherein the plastic film has an apparent specific gravity of 0.8–1.3, and the polyester film comprises a polyester and one or more thermoplastic resins incompatible with said polyester, said polyester film having fine voids formed by drawing in at least a monoaxial direction.

7. The surface-treated plastic film of claims 1, 4, 5, 2, 3 or 6, which has light permeability of not more than 30%, and inplane birefringence of not less than −0.02 and not more than +0.04.

* * * * *